US007934355B2

(12) United States Patent
Strub et al.

(10) Patent No.: US 7,934,355 B2
(45) Date of Patent: May 3, 2011

(54) DEVICE FOR AUTOMATICALLY EQUIPPING SUBSTRATES WITH MEDICAL AND/OR PHARMACEUTICAL AND/OR FOOD SUPPLEMENTING PRODUCTS AND SYSTEM FOR AUTOMATICALLY PRODUCING PACKAGING FOR MEDICAL AND/OR PHARMACEUTICAL AND/OR FOOD SUPPLEMENTING PRODUCTS

(75) Inventors: Nikolai Strub, Kaltenkirchen (DE); Gottfried Von Bismarck, Hamburg (DE); Gerhard Breu, Güttingen (CH); Christoph Hammer, Gams (CH); Roman Traber, Kreissern (CH); Erich Specker, Altstätten (CH)

(73) Assignee: AvidiaMed GmbH, Hamburg (DE)

( * ) Notice: Subject to any disclaimer, the term of this patent is extended or adjusted under 35 U.S.C. 154(b) by 231 days.

(21) Appl. No.: 12/158,532

(22) PCT Filed: Dec. 21, 2006

(86) PCT No.: PCT/EP2006/012642

§ 371 (c)(1),
(2), (4) Date: Jun. 20, 2008

(87) PCT Pub. No.: WO2007/077032

PCT Pub. Date: Jul. 12, 2007

(65) Prior Publication Data

US 2008/0302811 A1 Dec. 11, 2008

(30) Foreign Application Priority Data

Dec. 21, 2005 (EP) ..... 05090355

(51) Int. Cl.
*B65B 15/00* (2006.01)
*A61J 1/03* (2006.01)

(52) U.S. Cl. ..... 53/55; 53/513; 53/520; 53/251; 53/383.1; 83/367; 198/428; 198/433; 221/71

(58) Field of Classification Search ..... 53/244, 53/247, 251, 448, 55, 513, 520, 383.1, 389.1–389.3; 198/426, 428, 429, 431, 433; 83/367, 369; 221/71; *B65B 15/00, 15/02; A61J 1/03*
See application file for complete search history.

(56) References Cited

U.S. PATENT DOCUMENTS 3,534,524 A * 10/1970 Swezey ..... 53/141

(Continued)

FOREIGN PATENT DOCUMENTS

EP 0 852 208 A1 7/1998

(Continued)

OTHER PUBLICATIONS

International Search Report issued in PCT/EP2006/01242 dated May 7, 2007.

(Continued)

*Primary Examiner* — Stephen F Gerrity
(74) *Attorney, Agent, or Firm* — Venable LLP; Robert Kinberg; Christopher Ma

(57) ABSTRACT

An apparatus for automatically mounting substrates with medical and/or pharmaceutical and/or food-supplementing products, including at least one magazine to store blister strips rolled up on rolls or the like, each magazine having at least one holding position for the rolls, a delivery device to unroll the blister strips and deliver the unrolled blister strips to a supply position for the products provided by each roll in the magazine to be mounted, a separating device for separating product-filled blister sections from the blister strip, and a mounting head to receive, rotate and dispense the separated blister sections with the products sealed therein, the mounting head controlled by a control system to transport the separated blister sections from the supply position to a mounting position over the substrate.

34 Claims, 15 Drawing Sheets

U.S. PATENT DOCUMENTS

| | | | | |
|---|---|---|---|---|
| 3,732,544 | A | 5/1973 | Obland | |
| 4,737,904 | A * | 4/1988 | Ominato | 83/369 |
| 5,329,750 | A * | 7/1994 | Bagley et al. | 53/559 |
| 5,562,384 | A * | 10/1996 | Alvite et al. | 414/226.01 |
| 5,630,347 | A * | 5/1997 | Elvio | 83/367 |
| 5,752,365 | A * | 5/1998 | Johnson et al. | 53/435 |
| 5,862,646 | A * | 1/1999 | Orillo | 198/375 |
| 5,918,444 | A * | 7/1999 | Kuchler | 53/517 |
| 6,752,257 | B2 * | 6/2004 | Monti | 198/433 |
| 6,805,528 | B2 * | 10/2004 | Monti | 414/797.3 |
| 6,922,977 | B2 * | 8/2005 | Agostini et al. | 53/251 |
| 6,948,608 | B2 * | 9/2005 | Monti | 198/426 |
| 7,073,312 | B2 * | 7/2006 | Battisti | 53/543 |
| 7,128,520 | B2 * | 10/2006 | Monti | 414/794.2 |
| 2003/0079446 | A1 * | 5/2003 | Behnke | 53/473 |
| 2003/0085101 | A1 * | 5/2003 | Monti | 198/433 |
| 2004/0020747 | A1 * | 2/2004 | Monti | 198/433 |
| 2004/0026293 | A1 * | 2/2004 | Hughes | 206/538 |
| 2007/0251804 | A1 * | 11/2007 | Hahnel et al. | 198/469.1 |
| 2009/0044497 | A1 * | 2/2009 | Falat et al. | 53/478 |

FOREIGN PATENT DOCUMENTS

| | | |
|---|---|---|
| GB | 2 295 820 | 6/1996 |
| WO | WO-03/032704 A1 | 4/2003 |
| WO | WO-2005/102841 A1 | 11/2005 |

OTHER PUBLICATIONS

Written Opinion issued in PCT/EP2006/012642 dated May 7, 2007.

* cited by examiner

DEVICE FOR AUTOMATICALLY EQUIPPING SUBSTRATES WITH MEDICAL AND/OR PHARMACEUTICAL AND/OR FOOD SUPPLEMENTING PRODUCTS AND SYSTEM FOR AUTOMATICALLY PRODUCING PACKAGING FOR MEDICAL AND/OR PHARMACEUTICAL AND/OR FOOD SUPPLEMENTING PRODUCTS

CROSS-REFERENCE TO RELATED APPLICATIONS

This application is a National Stage Application of PCT/EP2006/012642, filed Dec. 21, 2006, which designates the United States and claims the priority of European Patent Application No. 05090355.8, filed on Dec. 21, 2005.

BACKGROUND OF THE INVENTION

The invention relates to an apparatus for automatically mounting substrates with medical and/or pharmaceutical and/or food-supplementing products, comprising at least one magazine for storing blister strips rolled up on rolls or the like, each magazine having at least one holding position for the rolls, and a delivery device for unrolling the blister strips and delivering the unrolled blister strips to a supply position for the products to be mounted being provided for each roll in the magazine, and a mounting head which can be controlled by a control system for transporting the products from the supply position to a dispensing position on the substrate.

Furthermore, the invention concerns a system for automatically manufacturing packaging for medical and/or pharmaceutical and/or food-supplementing products, comprising a transport unit for transporting substrates and the like through the whole system, a gluing station for applying hot-melt adhesive or the like to the substrates as well as an apparatus for mounting the substrates with medical and/or pharmaceutical and/or food-supplementing products.

Apparatuses and systems of this kind are used in the pharmaceutical and/or packaging industry to assemble individual packaging units from products. Such packages are e.g. adapted to certain treatment processes. In other words, each package is assembled individually.

This requires high expenditure on logistics and control. Furthermore, in the manufacture of packages for medical and/or pharmaceutical and/or food-supplementing products there are various, sometimes official requirements and conditions, e.g. of a health, safety or other type, the implementation of which means considerable expenditure (e.g. creating superclean-room conditions, high personnel costs, etc.).

It is quite normal in hospitals, old people's homes and care homes, etc. to manually assemble the packaging units individual to the patient, in which the products, namely drugs etc. lie loosely adjacent to each other. In other words, the products necessary for the respective administration time are then kept together in a shell, a nest or the like. This procedure or this principle of course has the advantage that all products to be taken at the respective administration time are located adjacent to each other, which allows an extremely high packing density and therefore relatively small packaging units, as there is only one shell or one nest for each administration time. Furthermore, with this principle, with just one operation of pressing out the shell or nest, all the products contained therein can be removed. The procedure described also means, however, that the products are released or unpacked from the package. In addition to the problem of cross-contamination, this method of manufacture is not only very time- and personnel-intensive. Manual assembly of the products individual to the patient also increases the risk of mistakes in mounting, which can under certain circumstances lead to unwanted side effects. A further drawback lies in that automatic monitoring can be carried out only with difficulty or not at all.

To automate a mounting operation, from the state of the art are known basically different types of apparatuses for mounting, so-called automatic mounting machines, which however are usually designed for assembling electronic components for printed circuit boards or the like. In the pharmaceutical and/or packaging industry, however, in the manufacture of treatment-specific and/or patient-individual packages it is also desirable and increasingly also necessary for automation to be carried out.

Thus from WO 2005/102841 A1 is known a system for automatically mounting packaging units of drugs. This system is distinguished by the fact that the products (capsules, tablets, dragées, etc.) are deposited specifically for a patient in holding compartments arranged in rows and columns, wherein several products are located directly adjacent and against each other in each compartment. WO 2005/102841 A1 retains the principle described above of manual mounting with a plurality of different products in a single shell or a single nest for each administration time, and increases the efficiency of this principle by carrying it out in automated fashion. The actual apparatus for filling the compartments includes for each product an output station. Between rolls on which the products are rolled up as strip blisters and the output stations is provided a transverse conveyor which ensures transport of the strip blisters into the region of the output station. The output stations are assigned ejector units by means of which the products are pushed out of the strip blisters. In other words, the products are subjected to direct mechanical stress and conveyed unprotected into the holding compartments. The disadvantage of this system is firstly the fact that there is the risk of cross-contamination because several identical or different products are pushed into the holding compartments. Secondly there are basic hygiene problems because the mechanical stresses necessary when pushing out the products lead to abrasion of the products which remain in the apparatus. As a result, the risk of cross-contamination is further increased. A further drawback lies in that this system has very high space requirements, because for each product a pressing-out station with associated ejector unit is necessary, which are all arranged in a row.

SUMMARY OF THE INVENTION

It is therefore the object of the present invention to propose a compact apparatus for automatically assembling substrates, which ensures mounting which is careful with the products and can be carried out universally. Further, it is an object to propose a system for automatically manufacturing packaging.

This object is achieved by an apparatus of the kind mentioned hereinbefore by the fact that the apparatus has separating means for separating product-filled blister sections from the blister strip, and the mounting head is designed to receive, rotate and dispense the separated blister sections with the products sealed therein. As a result, the products are handled only indirectly. In other words, the separating means creates the possibility of "apportioning" the products in packaged form in such a way that they do not have to be unpacked to assemble an individual package. Firstly this ensures that there are no risks of (cross-) contamination. Secondly the products are also protected against direct mechanical damage during the process of manufacturing the package. Also, the manufacture of such packages can be carried out in clean-room conditions which have substantially lower requirements than superclean-room conditions, which reduces the expenditure in manufacture and hence the costs.

Preferably, two holding positions of a magazine are arranged one above the other, which leads to the fact that the apparatus can be made even more compact.

In a preferred development of the invention the holding positions of a magazine arranged one above the other are laterally offset from each other. As a result, the two rolls can be used simultaneously, that is, without wasting time.

An appropriate embodiment of the invention provides that the magazines are standardised, such that each magazine can be assembled at any position of the apparatus. Thus the magazines can already be pre-fitted in order to ensure a short changing cycle. Furthermore, the mounting times can be improved due to the possibility of optimum placement of the magazines on the apparatus.

An advantageous embodiment provides that the magazines are of modular construction, such that they can be exchanged on the so-called plug and play principle. Hence rapid elimination of errors or rapid exchange of magazines is ensured.

Advantageously, the rolls are mounted circumferentially in the magazines or holding positions, which ensures easier and quicker changing of rolls.

In an appropriate development of the invention, the mounting head has two belt segment drives for pivoting the mounting head back and forth in two planes. As a result, very short paths of travel of the mounting head can be produced.

The object is also achieved by a system of the kind mentioned hereinbefore by the fact that the or each mounting apparatus is designed according to any of claims 1 to 25. The resulting advantages have already been mentioned above, so that at this point reference is made to the above statements to avoid repetition.

BRIEF DESCRIPTION OF THE DRAWINGS

Further preferred and/or advantageous and/or appropriate features and developments of the invention are apparent from the subsidiary claims and the description. Particularly preferred embodiments are described in more detail with the aid of the attached drawings. The drawings show:

DETAILED DESCRIPTION

The apparatus and system shown in the figures are used for automatically manufacturing patient-individual packages which contain pharmaceutical and/or medical and/or food-supplementing products.

Figure 1:
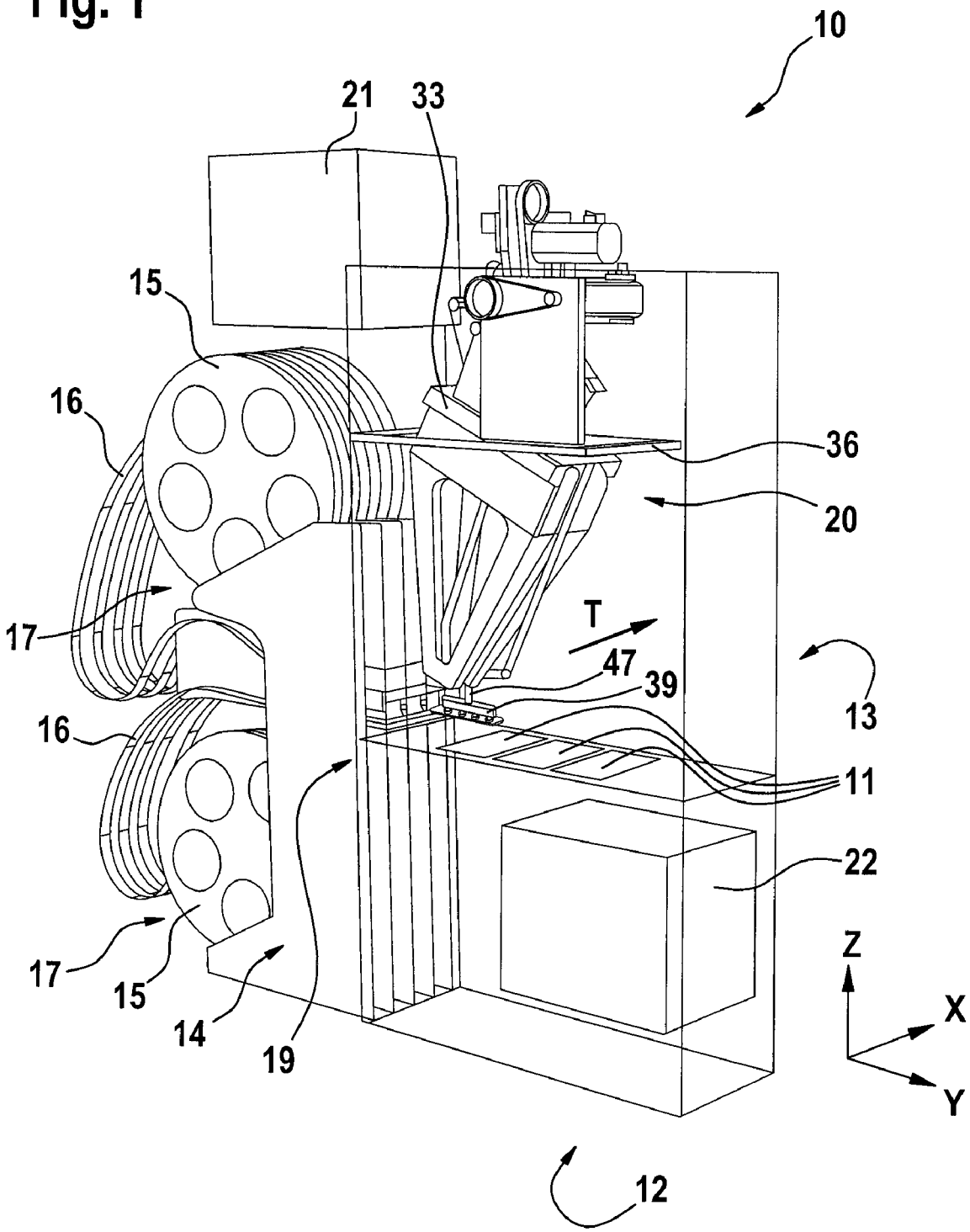
FIG. 1 a perspective view of an apparatus for automatic mounting, which includes several magazines for storing blister strips rolled up on rolls, and a mounting head, FIG. 2 a schematic side view of the apparatus of FIG. 1, FIG. 3 a schematic view of the mounting head of FIG. 2, FIG. 4 a side view of a further embodiment of the mounting head, FIG. 5 the front view of the mounting head of FIG. 4, FIG. 6 a perspective view of the mounting head obliquely from the rear, FIG. 7 a detailed view of the belt segment drives of the mounting head, FIG. 8 a detailed view of the suction bar of the mounting head, FIG. 9 a perspective view of a magazine as part of the apparatus of FIG. 1 with a side wall removed, FIG. 10 a schematic view of a delivery device with separating means as part of a magazine, FIG. 11 a detailed view of a strip feeder of the delivery device with holding positions arranged one above the other in alignment, FIG. 12 a schematic view of a further embodiment of the strip feeder of the delivery device with staggered holding positions, FIGS. 13 to 15 individual steps of the mounting sequence, and FIG. 16 a top view of a system for automatically manufacturing packaging with a mounting apparatus shown before.
Figure 2:
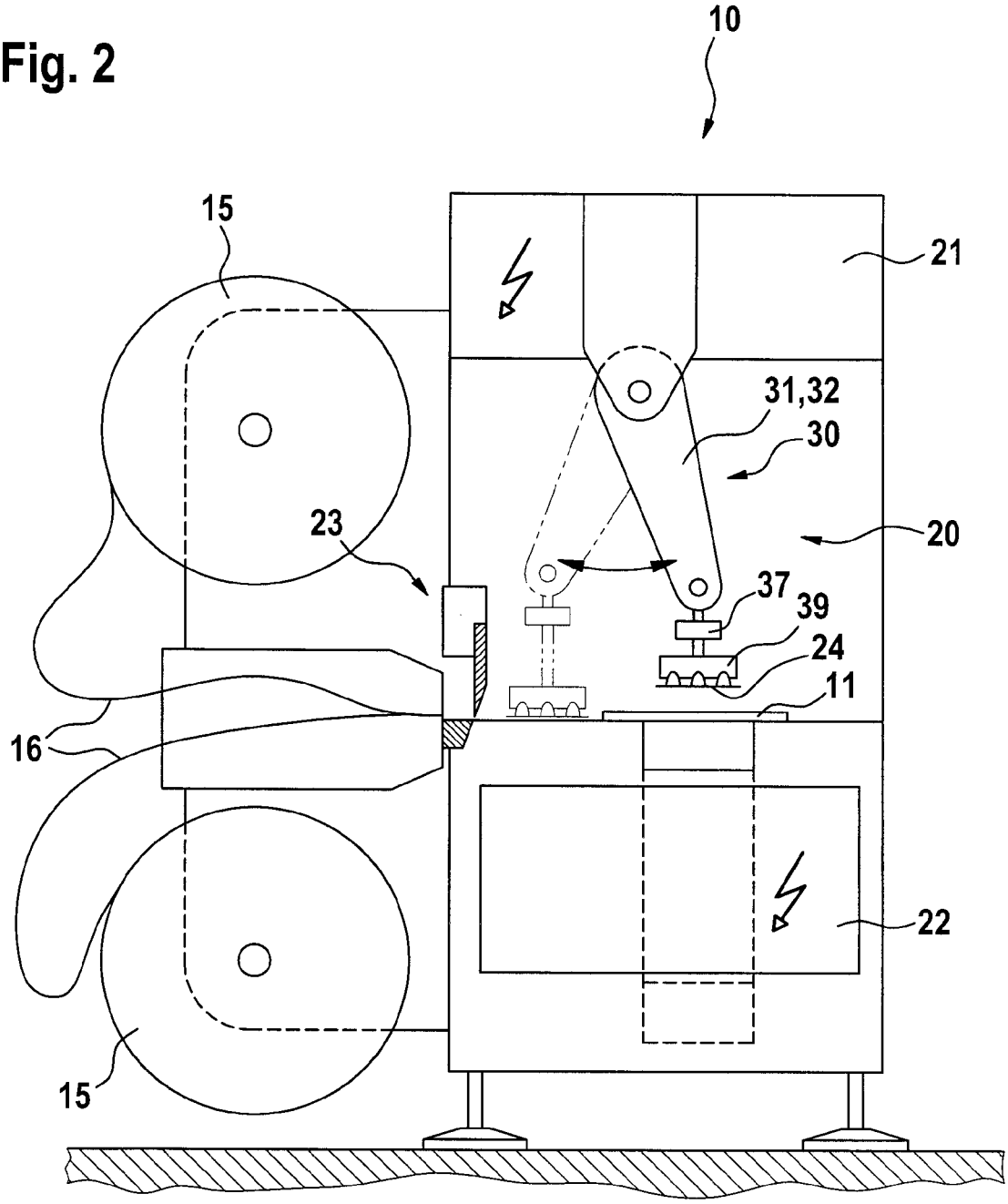

In FIG. 1 is shown an apparatus 10 for mounting substrates 11 which are delivered to the apparatus 10 in an input region 12, guided through the apparatus 10 in the direction of transport T and removed from the apparatus 10 in an output region 13. Such an apparatus 10 comprises at least one magazine 14, but preferably several magazines 14 arranged adjacent to each other. In the embodiment shown, the apparatus 10 has four such magazines 14. All the magazines 14 are preferably arranged on one side of the apparatus 10 in relation to the direction of transport T. In other words, all the magazines 14 are arranged adjacent to each other. But optionally, the magazines 14 can also be arranged on both sides in the direction of transport T of the substrates 11 through the apparatus 10. The magazines 14 are designed for storing or holding rolls 15, the rolls 15 carrying at least partially rolled-up, preferably single-strip blister strips 16. Each magazine 14 has at least one holding position 17, optionally several holding positions 17 for one or more rolls 15. Preferably, however, and also shown in FIG. 1, there are two holding positions 17 in each magazine 14. Each holding position 17 or each roll 15 is assigned a delivery device 18. The delivery devices 18 which are described in more detail below are used to unroll the blister strips 16 and deliver the unrolled blister strips 16 to a supply position 19 for the products to be mounted.

Further, the apparatus 10 has a mounting head 20 which is designed as a pendulum arm handling device. The mounting head 20 is designed to collect the products to be mounted from the supply position 19, transport them to the respective mounting position over the substrate 11, and deposit them on the substrate 11. The movements of the mounting head 20 can be controlled and/or regulated using a control system 21 which is shown schematically only. In addition to the control system 21 for the mounting head 20, the apparatus 10 has a further control system 22 for the magazines 14 or, to be more precise, the delivery devices 18, shown schematically only. The control systems 21, 22 can be functionally connected to each other, networked or even designed as a common integral control system.

The apparatus further comprises separating means 23 for separating product-filled blister sections 24 from the blister strip 16. The blister sections 24 can have different lengths. For example, a blister section 24 can have a minimum of one isolated product. In other words, such a blister section 24 is selected such that a single closed nest 25 with an isolated product therein is separated from the blister strip 16. As packages for the medical and/or pharmaceutical and/or food-supplementing products commonly contain at least one week's supply, and larger or smaller packaging units are of course possible, the maximum length of a blister section 24 to be separated is usually aimed at separating a maximum of seven filled nests 25 from the blister strip 16. It is however expressly pointed out that the lengths of the blister sections 24 and hence the number of products to be separated can be freely chosen.

The mounting head 20 is designed for holding, rotating and dispensing the blister sections 24 which have been separated from the blister strip 16 with the products sealed and isolated therein. In other words, the mounting head 20 has several axes of movement which enable the mounting head 20 to reach, apart from each supply position 19 in the apparatus 10, each point or each position on the substrate 11 to be mounted, and to place the blister sections 24 in the plane of the substrate 11 in any orientation. Therefore the mounting head 20 is movable on at least four axes. In the embodiments shown, the mounting head 20 has exactly four axes of movement. In addition to two pivot movements each for pivoting the mounting head 20 back and forth in one plane, namely the XZ plane on the one hand and the YZ plane on the other hand, the mounting head 20 or a suction bar 39 described below is additionally movable up and down in the Z direction perpendicularly to the substrate 11 to be mounted, as well as rotatable about the RZ axis (see in particular FIGS. 1 to 3 and 5).

Figure 6:
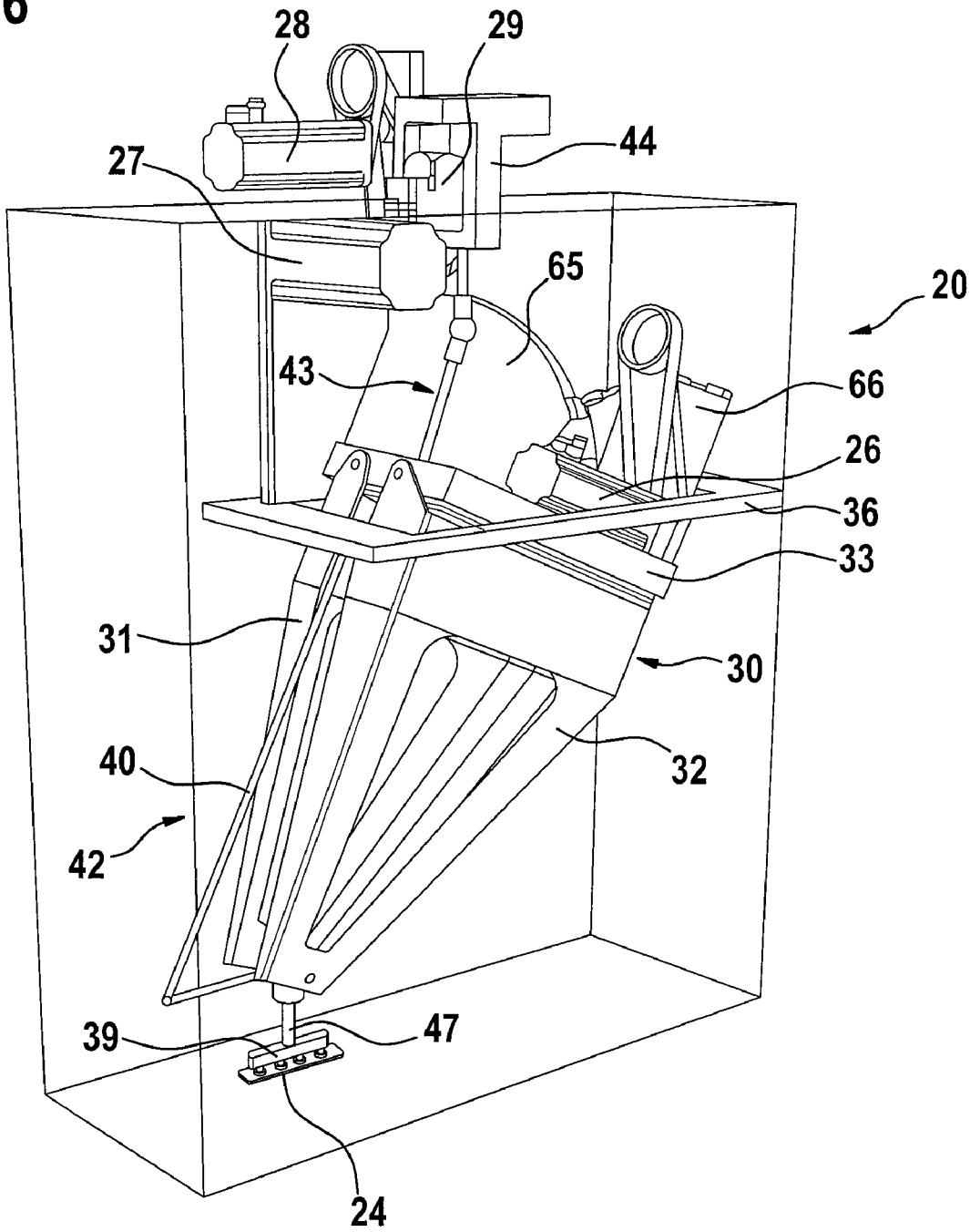

For the pivot movements, the mounting head 20 is assigned two belt segment drives 26, 27. The vertical movement in the Z direction as well as the rotary movement about the RZ axis are achieved by means of suitable drive motors 28, 29. In FIG. 6 can be seen particularly clearly the arrangement of the individual drives and motors which are described in more detail below. All the movements of the mounting head 20 can optionally be superimposed on each other. In other words the two pivot movements, the linear movement and the rotary movement can be performed simultaneously, that is, synchronously.

Figure 3:
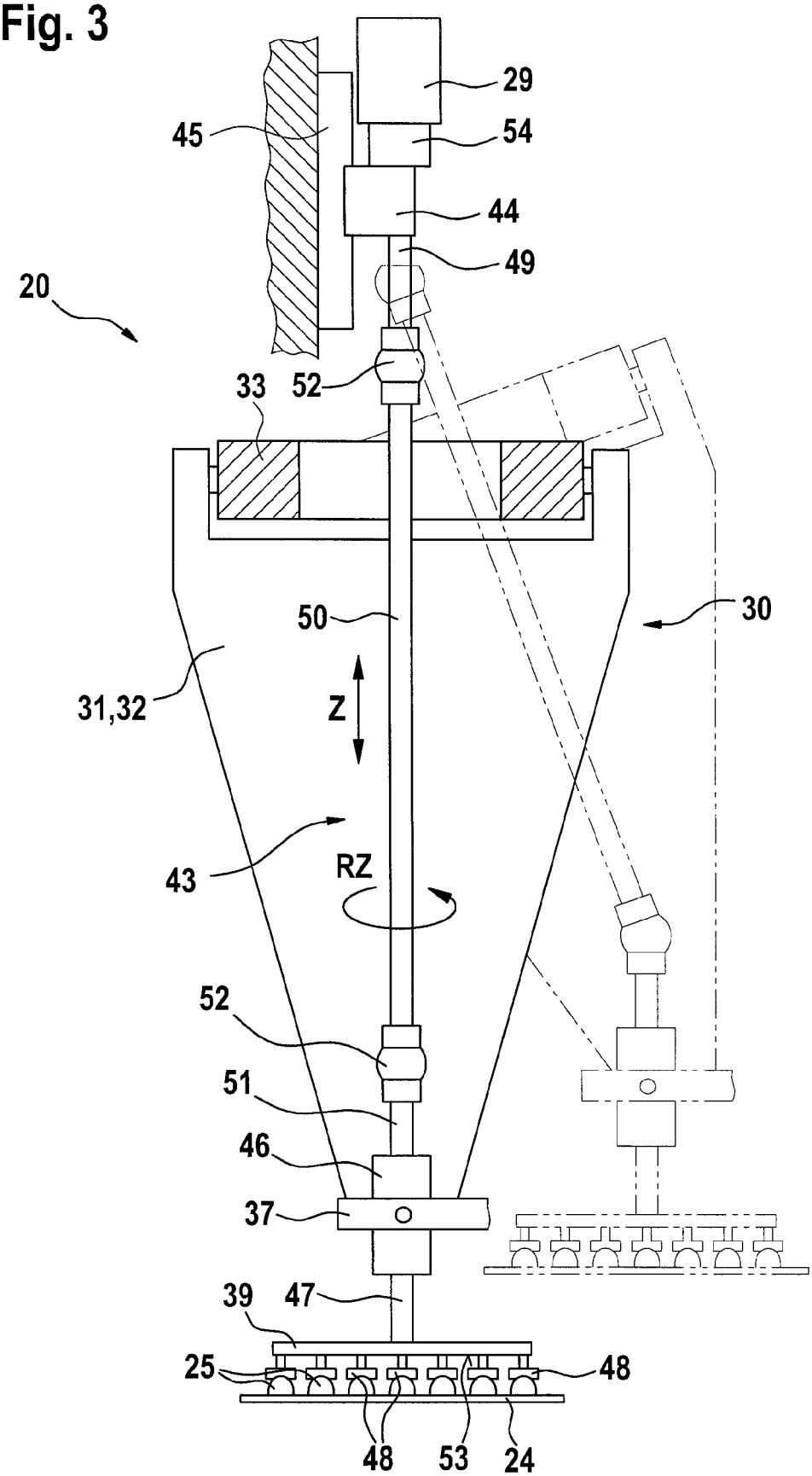
Figure 5:
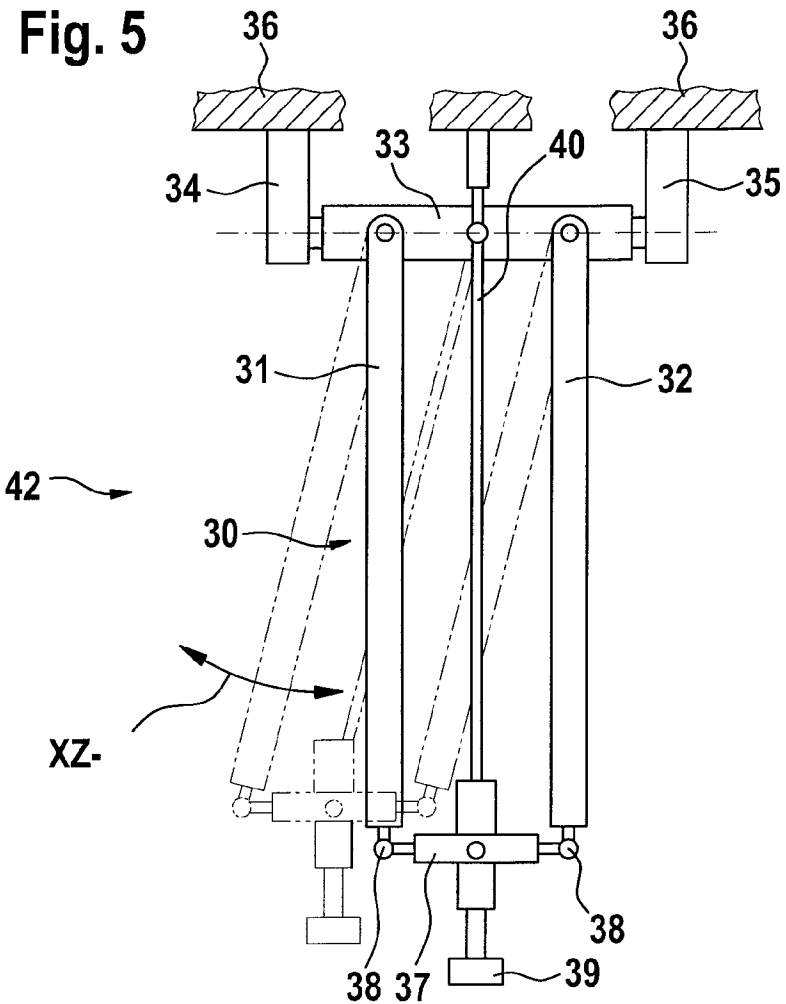
Figure 4:
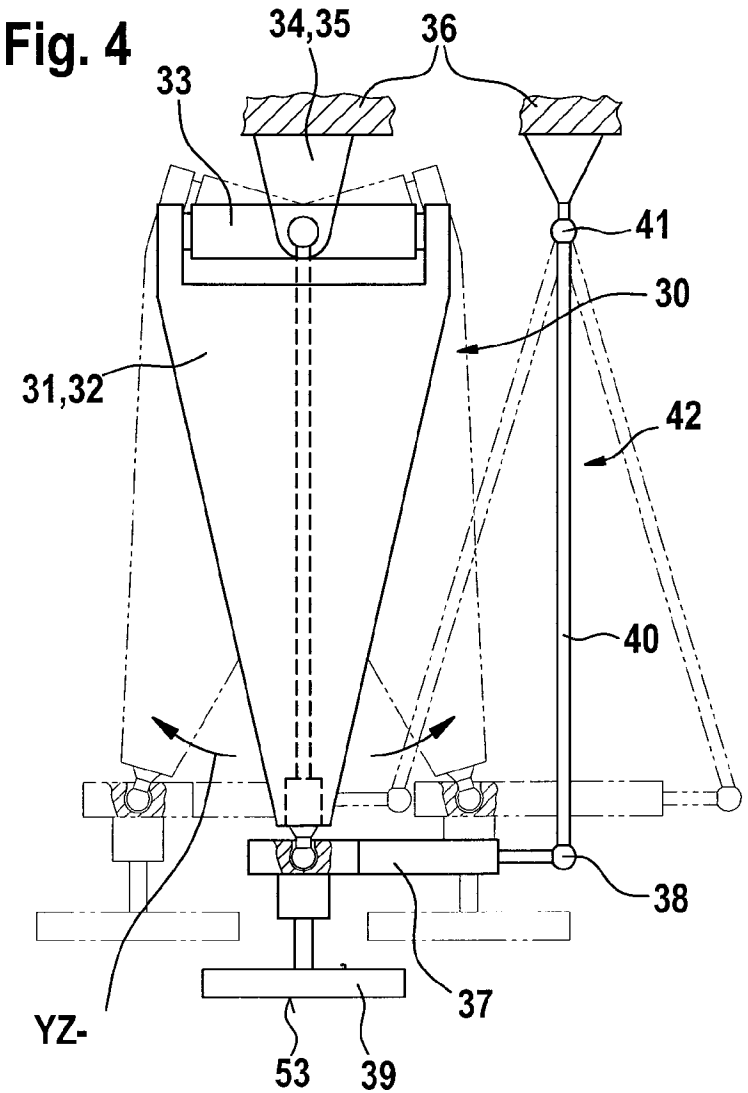

With the aid of FIGS. 3 to 5, the structure of the mounting head 20 is described in more detail. The mounting head 20 in the embodiments described is composed of a pendulum arm 30 which consists of two arms 31, 32 or triangle plates, beams or the like which run parallel and are spaced apart from each other (see in particular FIGS. 4 and 5). The two arms 31, 32 are attached to a common pivot plate 33 at their upwardly pointing free ends. This pivot plate 33 is arranged pivotably by corresponding bearing blocks 34, 35 or the like on a frame 36 or the like which is rigidly connected to the machine frame or forms part of the machine frame. On the side opposite the pivot plate 33, the arms 31, 32 are connected to each other by a head plate 37 or the like. In other words, the head plate 37 is pivotably connected to the arms 31, 32 at the downwardly directed free ends thereof by joint elements 38, for example, ball joints or the like. On the head plate 37 is arranged a suction bar 39 which is described in more detail below. Further, on the head plate 37 is optionally arranged a parallel rod 40. The parallel rod 40 is pivotably attached by the downwardly directed free end to the head plate 37 by joint elements 38, already mentioned. The other, upwardly directed free end of the parallel rod 40 is attached to the frame 36 by a ball joint block 41 or the like. In this case the two arms 31, 32 are attached to opposite sides of the head plate 37, while the parallel rod 40 is attached to one side of the head plate 37 which runs transversely to the above-mentioned sides. The parallel rod 40 is preferably made hollow, particularly for forming or holding supply lines or the like. This unit essentially composed of the arms 31, 32 or the arms 31, 32 and the parallel rod 40 can also be referred to as the differential rod arrangement 42.

Within this differential rod arrangement 42 is arranged an intermediate shaft 43 or the like. The intermediate shaft 43 is rigidly attached by an upwardly directed end to a lifting carriage 44 or the like, the lifting carriage 44 being arranged above the pivot plate 33 and associated with the machine frame. In other words, the lifting carriage 44 is movable up and down in the Z direction along suitable guides 45 vertically to the substrate 11 to be mounted. Alternatively, the frame 36 could be made generally movable up and down and guided to enable the vertical movement of the suction bar 39 in the Z direction. With its other, downwardly directed end, the intermediate shaft 43 is mounted in the region of the head plate 37. The bearing 46 used can be e.g. a combined rotary and linear bearing. In the region of the bearing 46 the intermediate shaft 43 is functionally or directly connected to a shaft 47 by the bearing 46 or within the bearing 46. The shaft 47 is in turn connected to the suction bar 39 already mentioned above or attached thereto. The shaft 47 can also be an extension of the intermediate shaft 43. The suction bar 39 itself has several, preferably seven nozzles or suction cups 48 or the like.

The intermediate shaft 43 in the embodiment shown is composed of three segments, namely a fastening segment 49, a differential segment 50 and a holding segment 51. The fastening segment 49 is preferably directly fastened to the lifting carriage 44 and so serves to transmit the vertical movement in the Z direction to the suction bar. The differential segment 50 serves to equalise the oscillating or pivot movement described by the pendulum arm 30. The holding element 51 makes the connection to the actual suction bar 39 and ensures that the suction bar 39 with its surface 53 facing towards the substrate 11 is oriented parallel to the substrate 11 permanently and independently of the pivot movement in the XZ plane and the YZ plane. In other words, the suction cups 48 are always oriented vertically to the substrate 11. The three segments 49 to 51 are preferably in each case connected to each other by universal joints 52 or the like. Alternatively, rubber joints or the like may be provided.

The mounting head 20 or, to be more precise, the suction bar 39 is connected to a vacuum system of the conventional kind, not shown explicitly. For this purpose the suction bar 39 is connected to at least one, but preferably several vacuum pipes. In the embodiment described, four preferably individually controllable suction pipes are provided, which are introduced into the intermediate shaft 43 in the region of the lifting carriage 44 by a suitable (multiple) rotary inserter 54 or the like. Hence selective control for suction of the blister sections 24 of different length is possible. In other words, individual suction cups 48 or groups of suction cups 48 can be controlled. The intermediate shaft 43 is made hollow, preferably tubular, for holding and guiding the vacuum pipes in all segments 49 to 51. Alternatively the intermediate shaft 43 can also be provided with vacuum bores or the like. In other embodiments the segments 49 to 51 can also be made different in relation to the vacuum pipes. In order to guide the vacuum pipes over the junctions between the individual segments 49 to 51, the universal joints 52 are designed as cardan joints with a hollow cross-piece. In the event that rubber joints are used, these have vacuum bores correspondingly. Further directly associated with the intermediate shaft 43 is the drive 29 which functions as a torque motor for rotating the intermediate shaft 43 about the RZ axis and can be driven in both directions of rotation.

Figure 7:
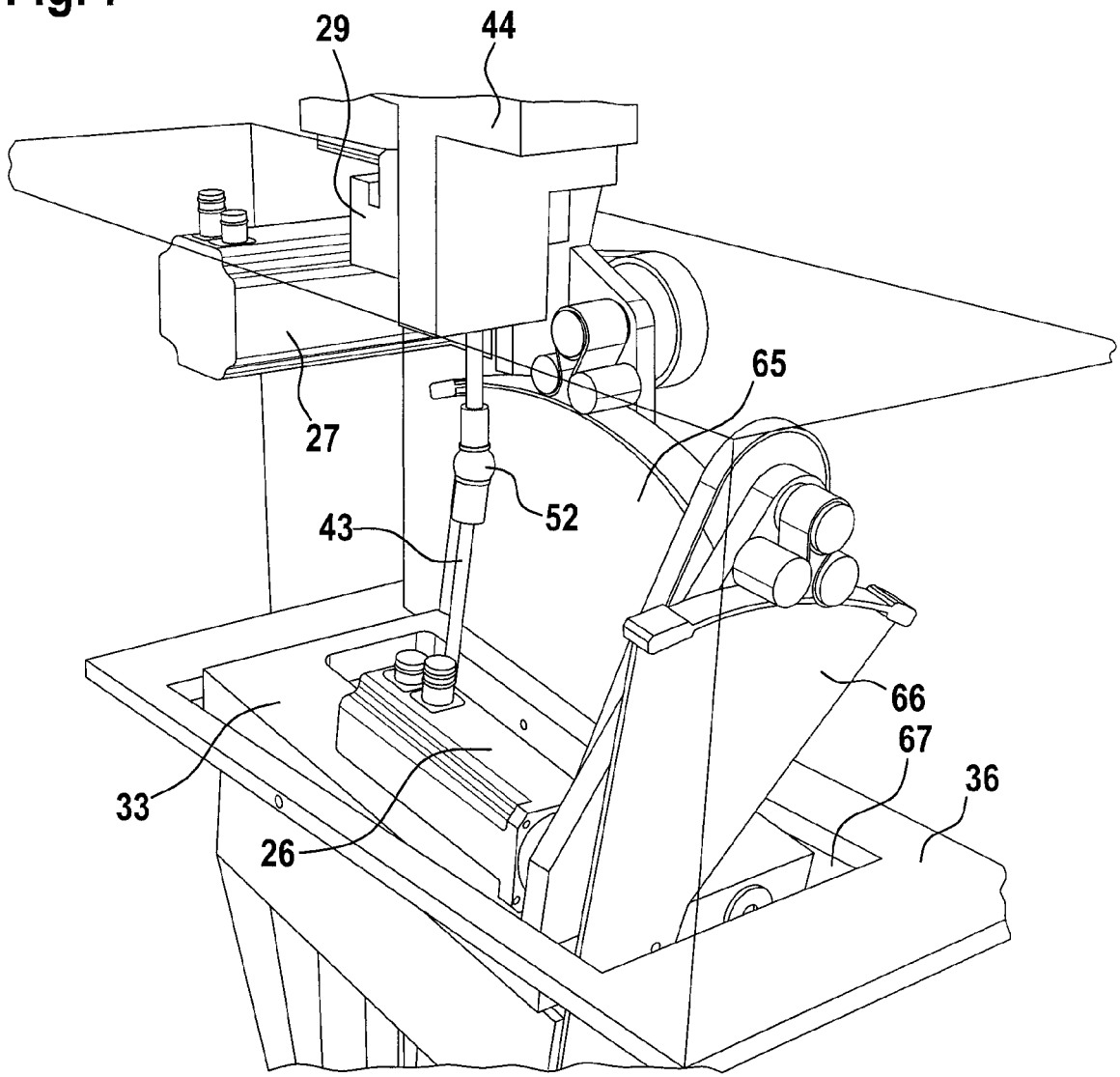
Figure 8:
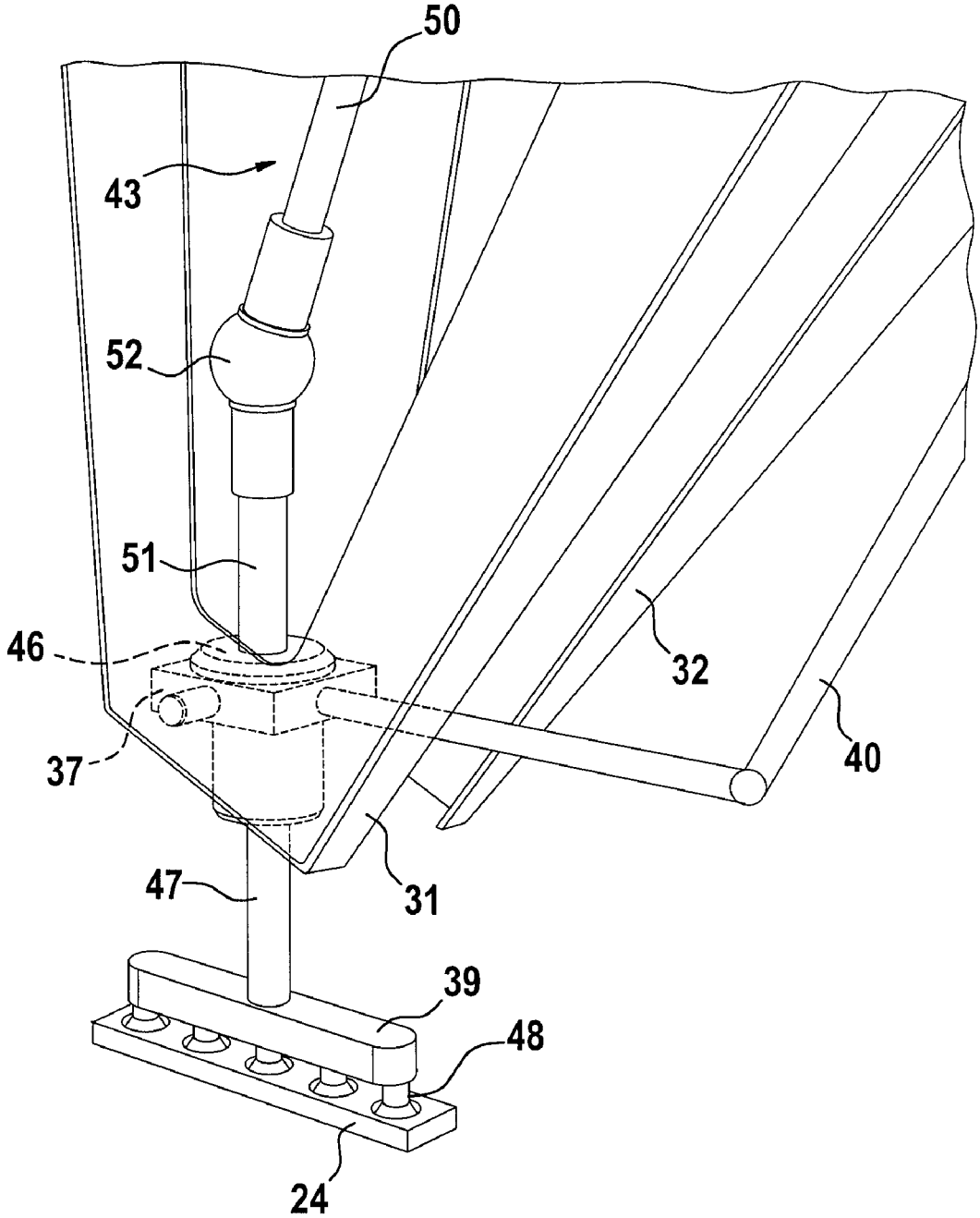

The vertical movement of the suction bar 39 in the Z direction is achieved by the drive 28 which is attached to the machine frame (see in particular FIGS. 6 and 7). The belt segment drive 27 for pivoting back and forth in the YZ plane is also associated with the machine frame. In this case the driving movement of the belt segment drive 27 can be transmitted by suitable and ordinary means to a circle segment-shaped section 65 which is in turn rigidly connected to the pivot plate 33. The belt segment drive 26 for pivoting back and forth in the XZ plane is, on the other hand, arranged on the pivot plate 33 in particular for achieving a compact design. In this case the driving movement of the belt segment drive 26 can be transmitted by suitable and ordinary means to a circle segment-shaped section 66 which is composed of an extension of one arm, here arm 32. Due to the fact that the arm 32 is connected to the arm 31 by the pivot plate 33, the pivot movement in the XZ plane is transmitted to the arm 31. In this case the frame 36, which apart from the rectangular shape provided with an aperture 67, can also be designed as a U-beam or the like, is constructed in such a way or provided with sufficient play in relation to the pivot plate 33 that free pivoting in both planes mentioned is ensured. The drives, in particular the belt segment drives 26, 27, are functionally connected to the suction bar 39 by the differential rod assembly 42 as well as the intermediate shaft 43 in such a way that the suction bar 39 with its suction cups 48 is always oriented the same in the direction of the substrate 11, regardless of the pivot position of the belt segment drives 26, 27.

Naturally, the drives 28, 29 are also directly functionally connected by the intermediate shaft 43 to the suction bar 39. Instead of the belt segment drives 26, 27 shown and described, other ordinary types of drive can also be produced, in particular for generating pivot movements. The differential rod assembly 42 can also be replaced by suitable known solutions such as e.g. a handling device with linear drives or a delta robot or the like.

Figure 9:
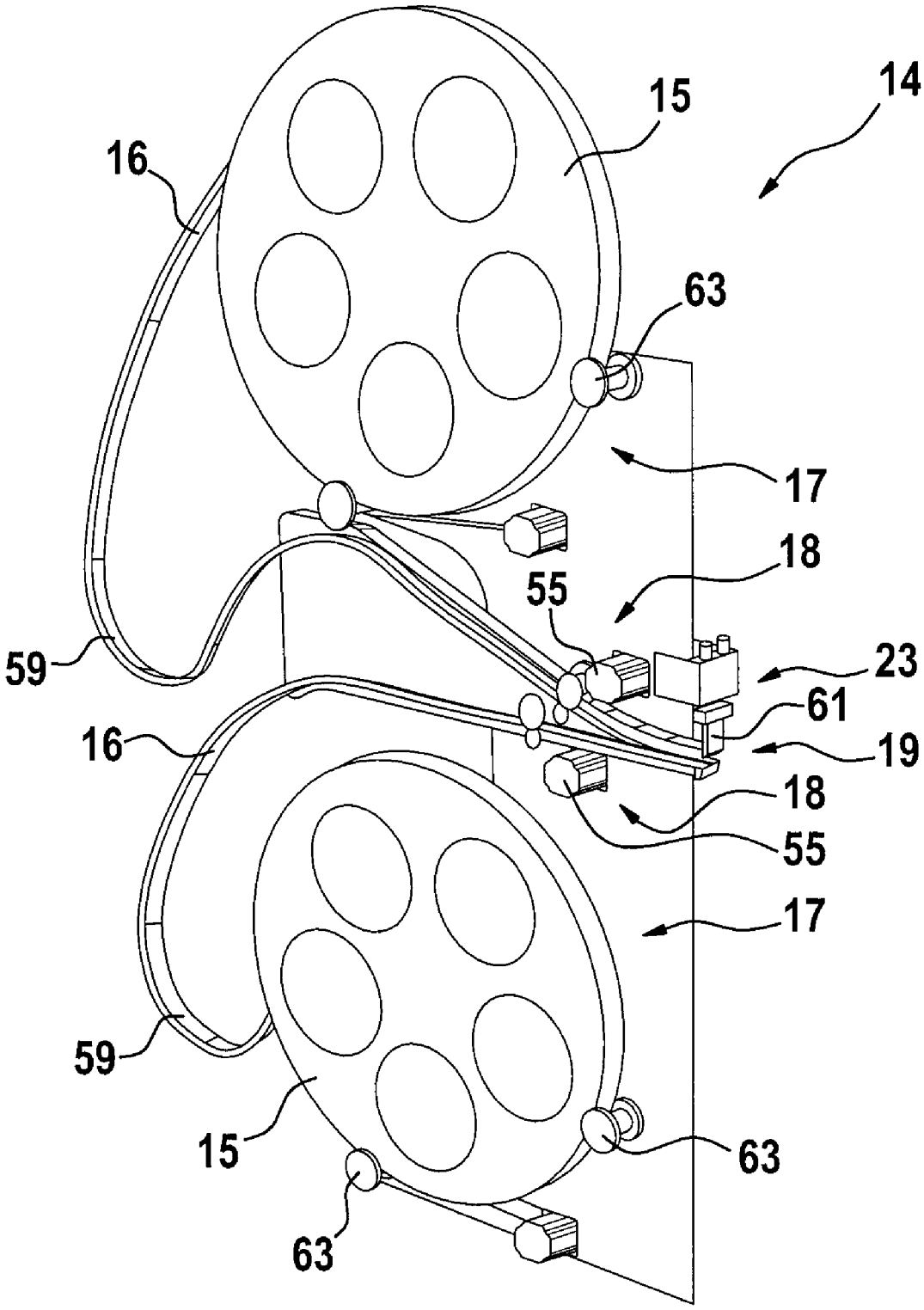
Figure 10:
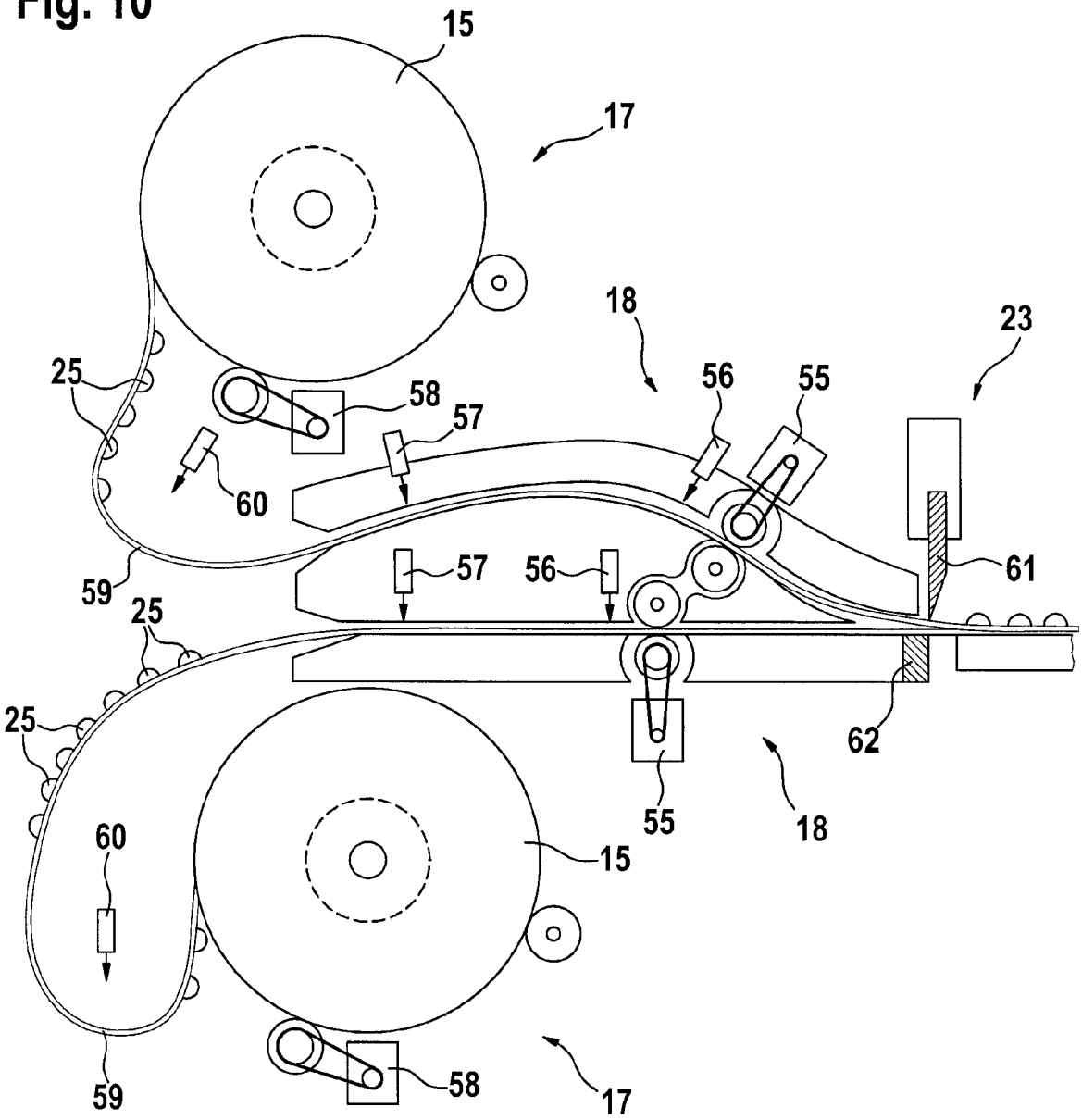
Figure 11:
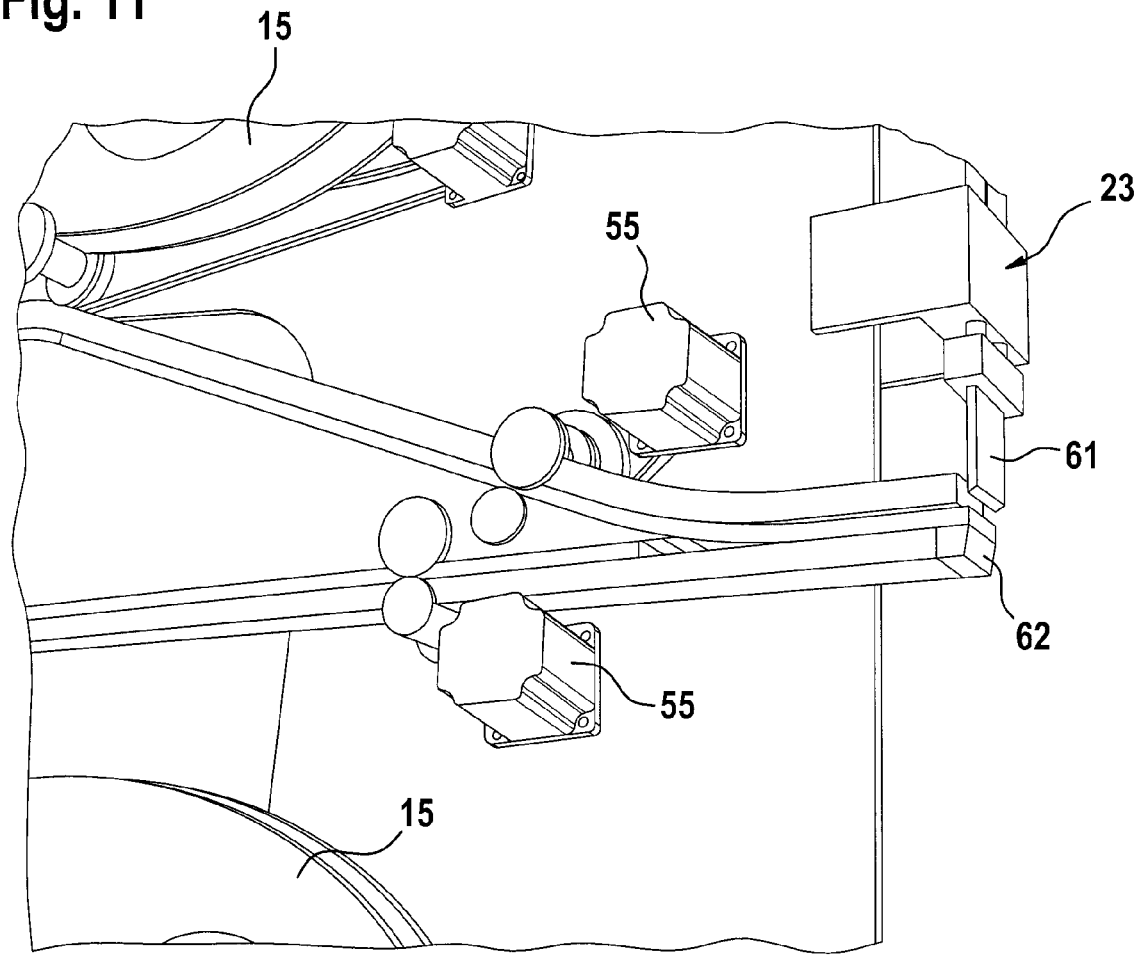
Figure 12:
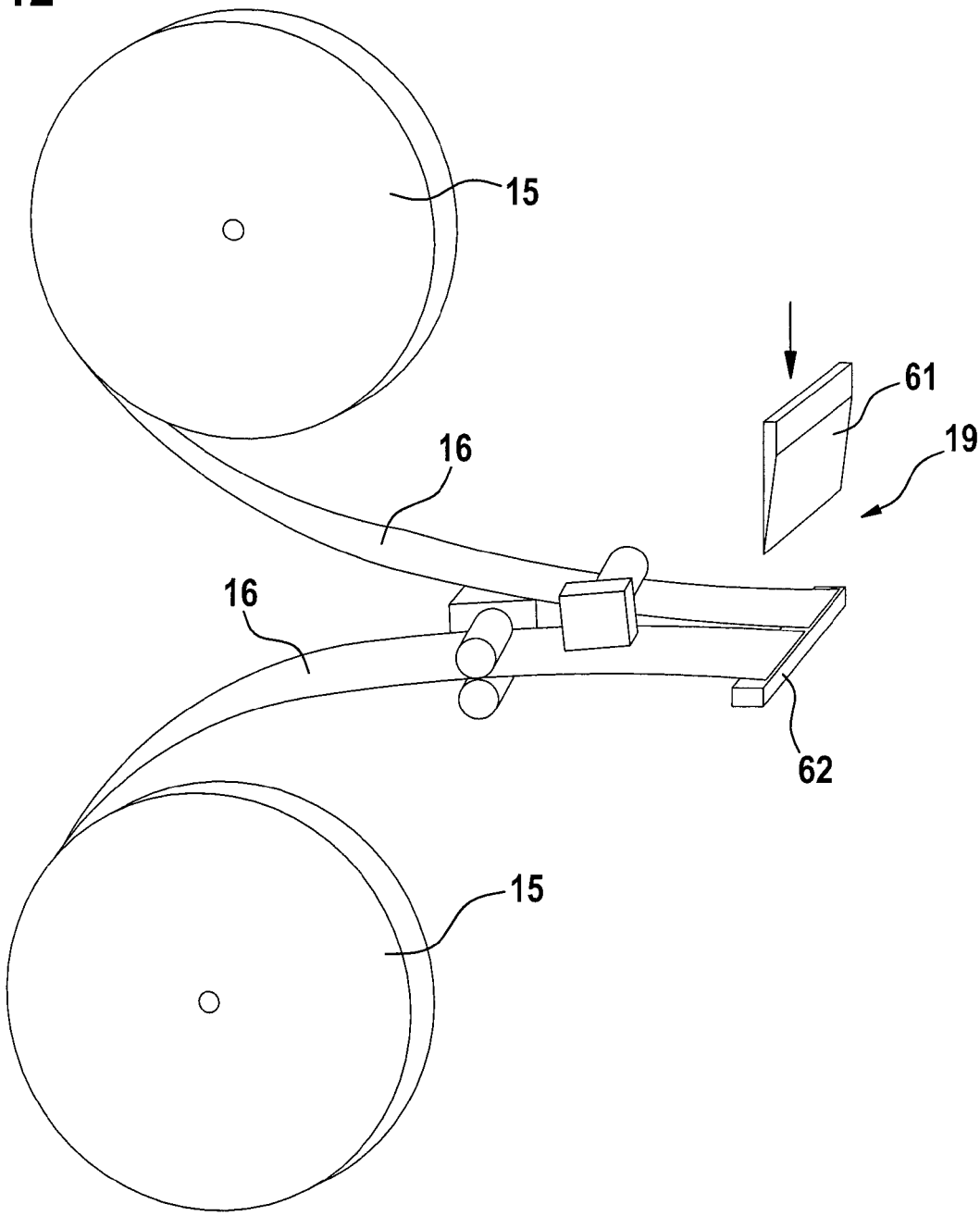

In addition to the mounting head 20, the magazines 14 with their delivery devices 18 are of central importance. In FIG. 9 is shown a single magazine 14 in open mode, that is, without the front side wall. As already mentioned above, each magazine 14 preferably includes two holding positions 17. This means that two rolls 15 are then arranged in one magazine 14. In the variant shown in FIG. 9, the holding positions 17 are arranged one above the other, this being in such a way that the holding positions 17 or, to be more precise, the rolls 15 arranged therein are oriented in alignment. This means that the blister strips 16 unrolled from the rolls 15 are arranged above or below each other. An alternative arrangement can be seen in FIG. 12 in which the holding positions 17 arranged one above the other are laterally offset from each other. In other words, the blister strips 16 unrolled from the rolls 15 are then adjacent to each other in the supply position 19. The degree of lateral offset can vary, but is preferably at least the width of the blister strips 16 to be processed.

Each holding position 17 is assigned a delivery device 18 which is essentially composed of a feed motor 55 and a measuring means for controlling the advance of the blister strip 16. The measuring means can include several measuring elements, for example a sensor 56 for the feed rate of the blister strip 16 and/or a sensor 57 for the end of the blister strip 16. Optionally, the delivery device 18 can additionally have an unrolling motor 58 which in particular can be helpful when unrolling heavy rolls 15. Due to a speed difference between the unrolling speed on the one hand and the feed rate speed, a blister loop 59 may be formed. In the region of this blister loop 59 can be arranged a further sensor 60 which picks up information for a control unit for the blister loop 59, not shown explicitly, and passes it on. Each magazine 14 is assigned a separating means 23.

The separating means 23 can be composed of one or more separating elements, for example separating blades 61. In the embodiments shown in FIGS. 9 to 12, each magazine 14 is assigned a separating blade 61 common to both holding positions 17. The guillotine-like separating blade 61 is preferably arranged above the blister strips 16 to be separated. Below the blister strips 16, the separating blade 61 is assigned a corresponding countersupport 62. In further embodiments, not shown, each delivery device 18 can also be assigned separating blades 61. This means that each blister strip 16 is then separated by its own separating blade 61. This may be helpful in particular in the event that the blister strips 16 of a magazine 14 are located adjacent to each other in the supply position 19. The or each separating blade 61 can be actuated in a pneumatic, hydraulic or other normal manner.

The rolls 15 within the magazines 14 or in the holding positions 17 are mounted for easy changing. Here, circumferential mounting of the rolls 15 e.g. on suitable mounting pins 63 is preferred. Other types of mounting, for example, stub axles on which the rolls 15 are mounted centrally can also be used. Each roll 15 can be mounted in each magazine 14. This means that there is freedom of choice in how the rolls 15 are assigned to the magazines 14. In particular the magazines 14 are also of standardised design so that each magazine 14 can be expanded at any position on the apparatus 10. In addition to the standardised design of the magazines 14, they are also of modular construction. As a result, changing of the magazines 14 can be carried out in a simple manner e.g. on the plug and play principle.

Figure 13:
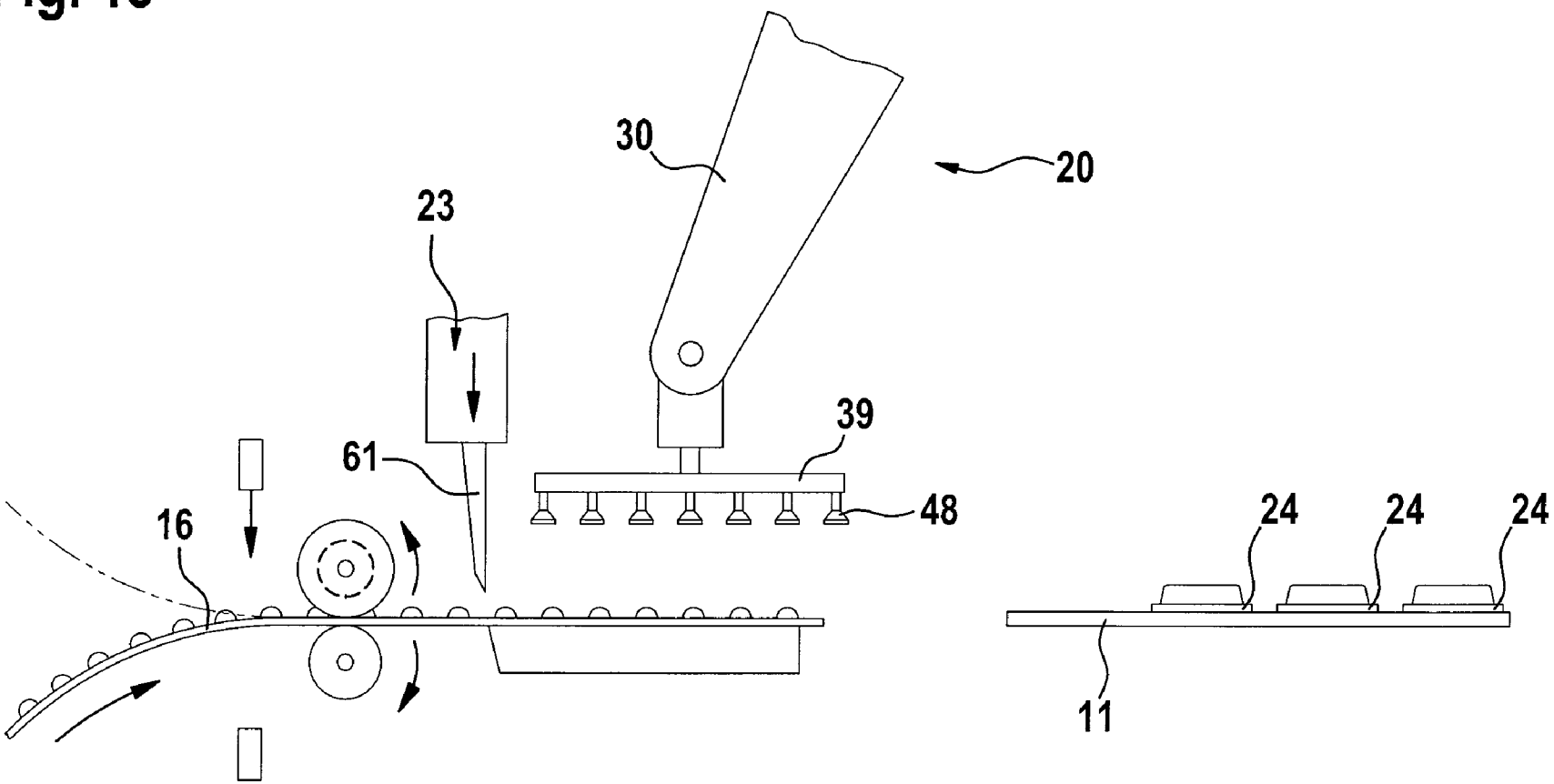
Figure 14:
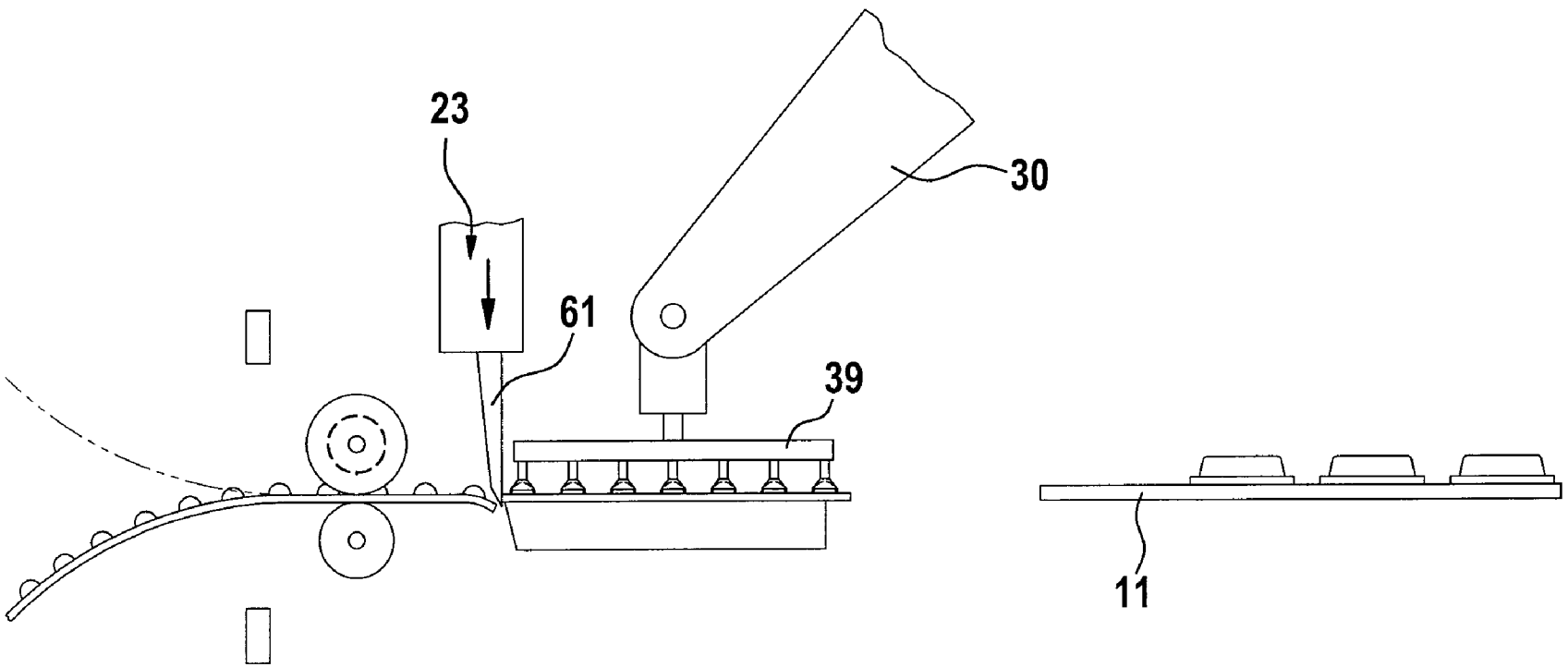
Figure 15:
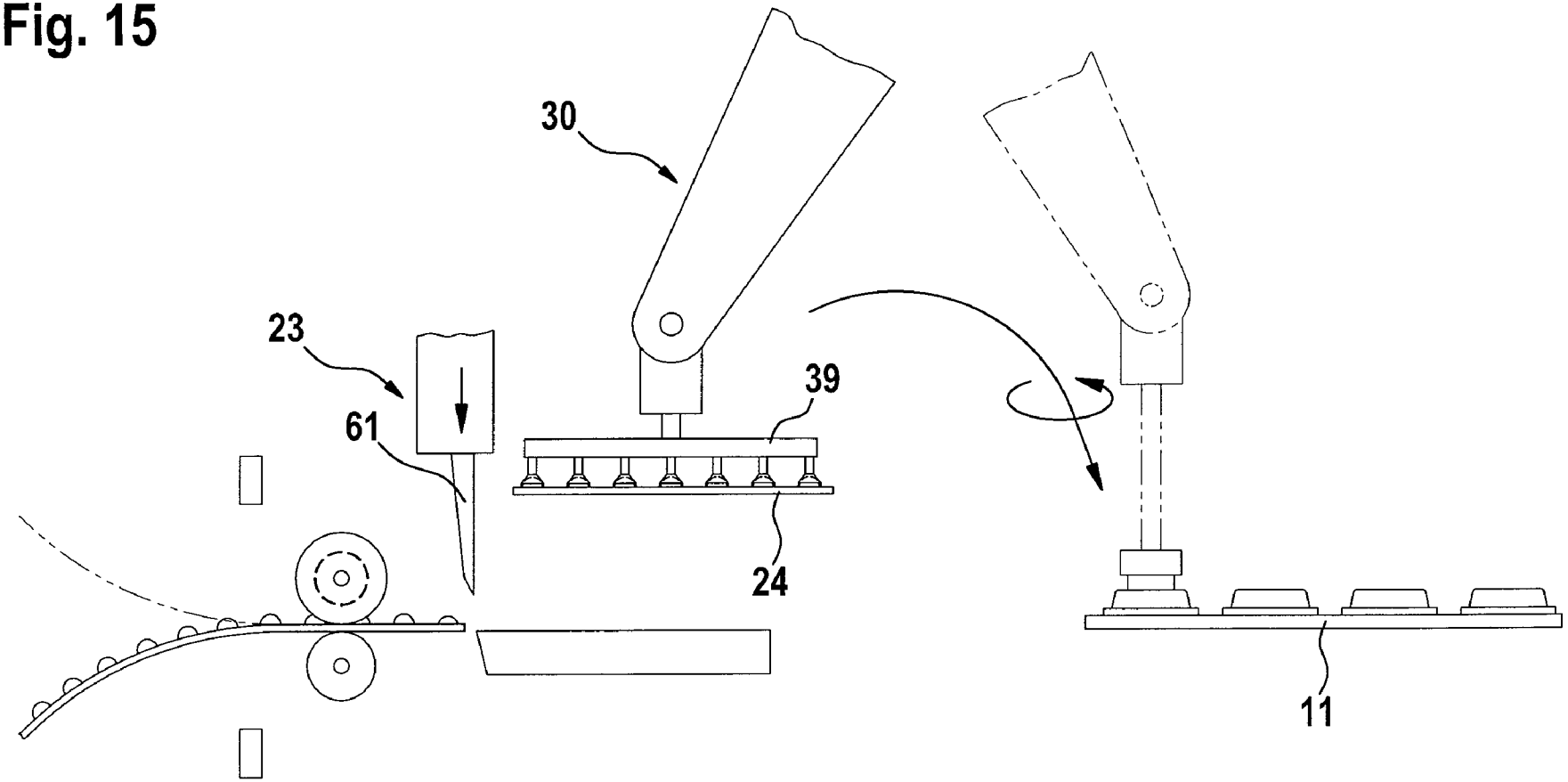

The sequence of steps for separating individual blister sections 24 from a blister strip 16 is described briefly with the aid of FIGS. 13 to 15. On insertion of a new roll 15 which carries a given product, first the corresponding position on the apparatus 10 is assigned by means of a code which is found e.g. directly on the roll 15. The blister strip 16 is then dispensed from the roll 15. Positioning of the blister strip 16 takes place likewise preferably by means of markings on the blister strip 16 which are suitable for optical detection. Pictorial representations, centring marks, holes, notches or the like can be used as the markings. The blister strip 16 can be predispensed by a variable length or number of products. This means that, if the mounting head 20 is to collect a single isolated and packed product at the supply position 19, the blister strip 16 is predispensed precisely by the length of a product. If mounting of a blister section 24 with several isolated and packed products is desired, the blister strip 16 is predispensed by the desired number of products. In the example of FIGS. 13 to 15, the blister strip 16 is predispensed in a length carrying seven products. As soon as the blister section 24 to be separated is in the preparing position 19, the blister section 24 to be separated is fixed by the descending suction bar 39. Preferably in parallel thereto the separating operation is commenced. This means that the separating blade 61 separates the blister section 24 from the blister strip 16, while the blister section 24 ready for mounting is fixed. The moment of separation can vary and in particular take place after fixing. Separation takes place between the nests 25, which are also called tablet wells. The separating cuts run optionally along perforations or the like that are provided or, without perforations, transversely to the blister strip 16. The separated blister section 24 is then picked up by the mounting head 20, possibly rotated and deposited on the substrate 11. After deposition of the blister section 24 on the substrate 11, it is checked optically whether the correct blister section 24 was deposited in the right position of the substrate 11.

Figure 16:
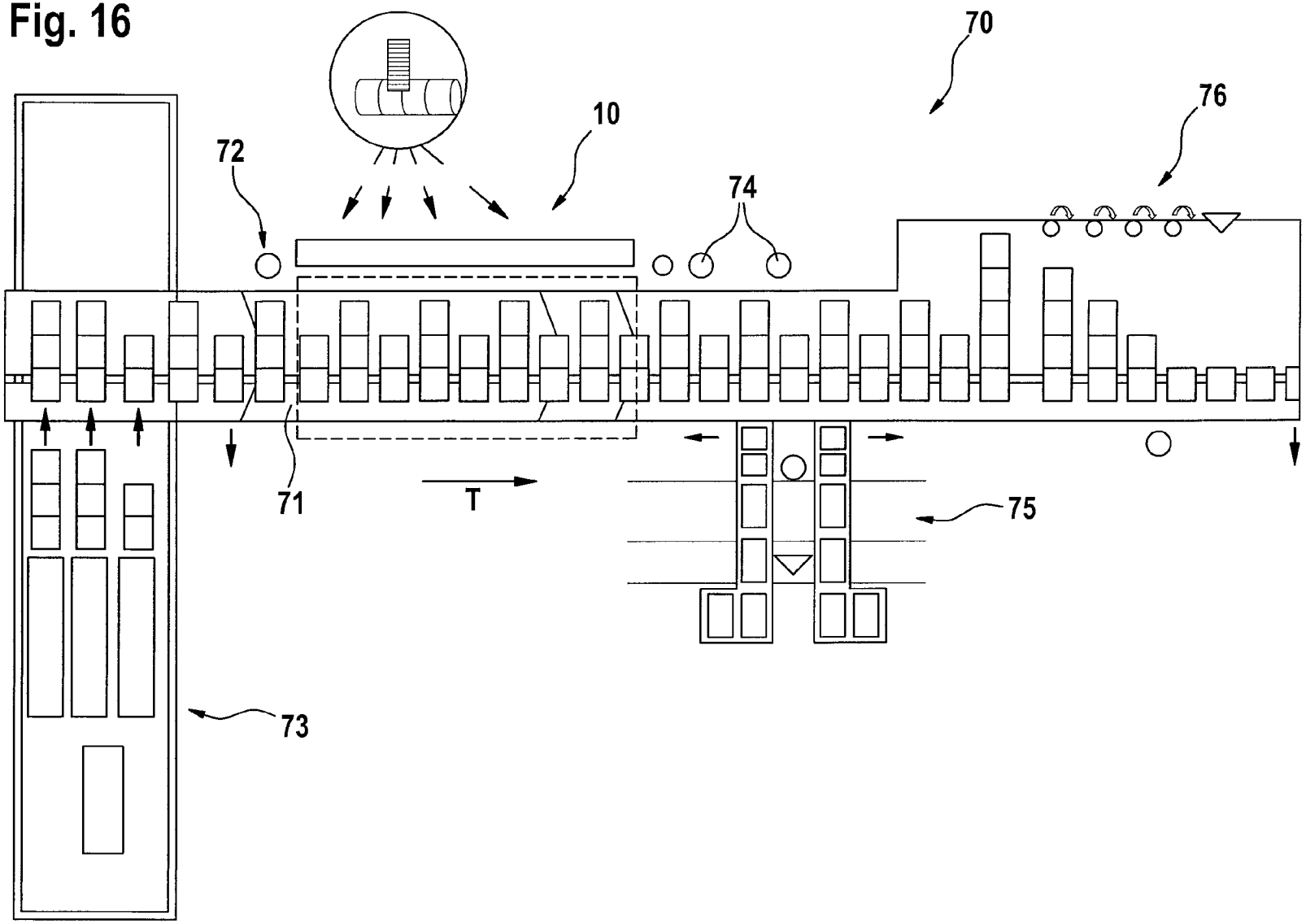

With reference to FIG. 16, a general concept for automatic manufacture of patient-individual packages is described. The composition of the individual components of the system 70 can of course vary, particularly in the number and sequence of components. One of the central components is the apparatus 10 for fitting the substrates 11. Other essential components are a transport unit 71 and a gluing station 72. By means of the transport unit 71, the substrates 11 can be transported in the direction of transport T through the apparatus 10 and through components mounted in front and behind. The transport unit 71 can be designed in a normal manner as a belt conveyor or the like. However, a design as an endlessly rotating vacuum chain is preferred. The gluing station 72 is mounted in front of the mounting apparatus 10 in the direction of transport T, and serves to apply hot-melt adhesive or the like to the substrates 11 at the positions at which blister sections 24 are positioned. The gluing station 72 could in certain circumstances be dispensed with if the blister sections 24 are fixed by the package itself, for example by clamping the blister sections 24 between the substrate 11 and a covering element or the like associated with the substrate 11.

Optionally, the system 70 can be supplemented by further components to increase the degree of automation, as is also shown in FIG. 16. Associated with the transport unit 71 on the input side can be a delivery device 73 for delivering the substrates singly and in an orderly fashion. The delivery device 73 is designed for automatically delivering different substrates 11, that is, for example, so-called wallets with two panels at the top or bottom, additional panels or the like. The wallets or the like are pre-perforated in the region of the nests 25 with standardised perforations. Several substrates 11 can be assembled from different wallets, panels or the like and are preferably already preprinted. The delivery device 73 can be arranged in alignment with the transport unit 71 or, as shown, as a transverse conveyor. Associated with or mounted behind the delivery device 73 is an inspection unit (not shown explicitly) by means of which the position and alignment of the substrates 11 on the transport unit 71 is monitored. If the flow of transport of the substrates 11 in the direction of transport T is followed, behind the apparatus 10 is provided—usually several of the apparatuses 10 are arranged one behind the other—a further inspection unit (not shown) for monitoring the mounting quality (e.g. position of the blister sections 24 on the substrate 11, correct choice and allocation of the blister sections 24, etc.). Optionally, the apparatuses 10 can also be equipped with optical inspection units. Then, in the embodiment shown is provided at least one further gluing station 74. This gluing station 74 can be used to connect hot glue or the like for connecting the mounted substrate 11 to the covering element or the like already described above. The covering elements or the like can be delivered by a further delivery device 75, e.g. to a magazine or the like of the transport unit 71. The covering elements can be printed individually for patients, in particular by printing information on the drug, date of taking, time of taking, manner of taking, company logo, etc. The holes or recesses for the nests 25 in the covering elements are stamped in a fixed pattern by suitable means which can be associated with the delivery device 75, producing different stamping patterns. The holes can also be prestamped. The delivery device 75 can also be used to discharge the mounted substrates 11 from the system 70. The delivery device 75 is in this case preferably arranged transversely to the transport unit 71. Behind the gluing station 74 in the direction of transport T is arranged a further processing unit 76. The processing unit 76 can include means for connecting the mounted substrates 11 to additional panels, for folding the substrates 11 or the units composed of substrate 11 and additional panel, for printing, stamping or the like of variable data, and for optical monitoring. Using suitable codes on the blister sections 24, the substrates 11, the covering elements, etc., mounting individually for the patients can be monitored 100%. In addition all variable data can be monitored online using cameras or the like.

Optionally, associated with the system 70 can of course be further components, such as for example a further gluing station in the region of the processing unit 76. Each component can further be assigned a means for discharging the products (e.g. empty substrates 11, glued substrates 11, fitted substrates 11, etc.). Thus in each section of the method, in case of defective or otherwise unwanted products, discharge from the process can take place. Furthermore not shown is a control unit for the system which can be designed as a single overriding unit. However, there is also the possibility of the individual components having separate units which are functionally connected by a common control system.

To sum up, it is once again stated that the mounting head 20 with its suction bar 39 is designed in such a way that the blister sections 24 can be collected from the stationary supply position 19 and delivered to the substrate 11. The advantage lies in that the bridge-like dispensing stations known from the above-mentioned WO document can be avoided, with the result that the time taken for a substrate 11 to pass through the apparatus 10 or the system 70 can be reduced and overall a shorter system 70 can be produced.

The invention claimed is:

1. Apparatus for automatically mounting substrates with medical and/or pharmaceutical and/or food-supplementing products, comprising:

at least one magazine to store a blister strip rolled up on a roll, a magazine of the at least one magazine having:

at least one holding position for the roll; and a delivery device to unroll the blister strip and deliver the unrolled blister strip to a supply position for the products provided by the roll in the magazine to be mounted;

a separating device to separate product-filled blister sections from the blister strip;

a mounting head to receive, rotate and mount the separated blister sections with the products sealed therein, the mounting head controlled by a control system to transport the separated blister sections from the supply position to a mounting position over the substrate;

wherein the apparatus is adapted to transport the substrate alongside the supply position for the products; and wherein the mounting head is movable on at least four axes.

2. Apparatus according to claim 1, wherein the at least one magazine comprises a plurality of magazines arranged adjacent to each other.

3. Apparatus according to claim 1, wherein the at least one holding position comprises at least two holding positions for the roll.

4. Apparatus according to claim 3, wherein the at least two holding positions for the roll are arranged one above the other.

5. Apparatus according to claim 4, wherein the at least two holding positions are arranged in alignment one above the other.

6. Apparatus according to claim 4, wherein the at least two holding positions for the roll arranged one above the other are laterally offset from each other by at least the width of the blister strips to be processed.

7. Apparatus according to claim 3, wherein the separating device is associated with the holding positions or the delivery device of the magazine.

8. Apparatus according to claim 7, wherein the separating device comprises a plurality of separating devices, each assigned to a respective one of the holding positions and hence a respective blister strip.

9. Apparatus according to claim 1, wherein the at least one magazine is standardized, wherein the at least one magazine is expandable at any position of the apparatus.

10. Apparatus according to claim 1, wherein the at least one magazine is of modular construction to be exchanged on the so-called plug and play principle.

11. Apparatus according to claim 1, wherein the roll is mounted circumferentially in the magazine or at least one holding position.

12. Apparatus according to claim 1, wherein the at least one magazine comprises a plurality of magazines arranged on one side of the apparatus.

13. Apparatus according to claim 1, wherein the delivery device further comprises an unrolling motor, a feed motor, a control unit for a blister loop formed by a speed difference between unrolling speed and feed rate speed, and elements for detecting information on feed rate on the end of the strip and on loop travel.

14. Apparatus according to claim 1, wherein the mounting head comprises two belt segment drives for pivoting the mounting head back and forth in two planes (XZ plane, YZ plane).

15. Apparatus according to claim 14, wherein the mounting head further comprises a drive for moving the mounting head up and down perpendicularly (Z direction) to the substrate, and a drive for rotating (RZ axis) the mounting head.

16. Apparatus according to claim 14, further comprising a common differential rod assembly associated with the belt segment drives.

17. Apparatus according to claim 16, further comprising an intermediate shaft associated with the differential rod assembly.

18. Apparatus according to claim 17, wherein the intermediate shaft comprises three segments connected to each other by universal joints.

19. Apparatus according to claim 17, wherein the intermediate shaft is designed for connection to a vacuum unit.

20. Apparatus according to claim 17, further comprising a suction bar associated with the mounting head to receive a blister section of variable length, wherein the suction bar is functionally connected to the differential rod assembly and the intermediate shaft so the suction bar with its surface facing towards the substrate is always oriented parallel to the substrate, regardless of the pivot position of the belt segment drives.

21. Apparatus according to claim 1, further comprising a suction bar associated with the mounting head to receive a blister section of variable length.

22. Apparatus according to claim 21, wherein the suction bar on the surface facing towards the substrate has at least one suction cup.

23. Apparatus according to claim 1, wherein the mounting head and the delivery device have separate control systems.

24. Apparatus according to claim 23, wherein the control systems are functionally connected or networked to each other.

25. Apparatus according to claim 1, further comprising a transport unit adapted to transport the substrate alongside the supply position for the products.

26. System for automatically manufacturing packages for medical and/or pharmaceutical and/or food-supplementing products, comprising a transport unit for transporting substrates through the whole system, a gluing station for applying hot-melt adhesive to the substrates, and the apparatus for mounting the substrates with medical and/or pharmaceutical and/or food-supplementing products according to claim 1.

27. System according to claim 26, further comprising a delivery device assigned to an input region in the transport unit to automatically deliver substrates to the transport unit.

28. System according to claim 26, further comprising a sensor in front of the gluing station in a direction of transport T of the substrates to monitor the position of the substrates on the transport unit.

29. System according to claim 26, further comprising a sensor immediately behind the mounting apparatus in a direction of transport T to monitor mounting with respect to position and/or content.

30. System according to claim 26, further comprising means for stamping and/or breaking out and/or printing and/or folding the fitted substrates assigned to the transport unit.

31. System according to claim 26, further comprising gluing stations behind the apparatus in a direction of transport T to apply hot glue and/or hot-melt adhesive in the region of the transport unit.

32. System according to claim 26, further comprising means for discharging the substrates assigned to the transport unit for processing.

33. System according to claim 26, further comprising an overriding control unit to control and/or regulate all components of the system.

34. System according to claim 26, wherein the transport unit includes a vacuum chain.

* * * * *